United States Patent [19]

Bryer

[11] 4,020,760

[45] May 3, 1977

[54] PRINTING INK METERING PUMP

[75] Inventor: Jack Bryer, Paramus, N.J.

[73] Assignee: Wood Industries, Inc., Middlesex, N.J.

[22] Filed: Dec. 15, 1975

[21] Appl. No.: 640,840

[52] U.S. Cl. ..... 101/366; 417/500

[51] Int. Cl.[2] ..... B41F 3/08; F04B 7/06; F04B 37/10

[58] Field of Search ..... 101/366, 147; 417/500; 92/13; 137/565.1, 565.2

[56] References Cited

UNITED STATES PATENTS

| | | | |
|---|---|---|---|
| 838,565 | 12/1906 | McCanna | 92/13 X |
| 2,843,044 | 7/1958 | Mashinter | 417/500 X |
| 3,636,873 | 1/1972 | Fusco | 101/366 |
| 3,651,756 | 3/1972 | Smith, Jr. | 101/147 |

FOREIGN PATENTS OR APPLICATIONS

| | | | |
|---|---|---|---|
| 44,295 | 3/1926 | Norway | 417/500 |

*Primary Examiner*—J. Reed Fisher

*Attorney, Agent, or Firm*—Pennie & Edmonds

[57] ABSTRACT

A variable stroke positive displacement liquid metering pump unit having a rotatable plunger which is moveable in an axial direction within a cylindrical pump casing. The plunger has a flat portion which is adapted to overlie the inlet and outlet ports during different degrees of rotation. A variable stroke drive means is provided to vary the distance the plunger moves outwardly of the casing in a liquid infeed direction to vary the amount of liquid metered.

A plurality of pump units are provided in a line across a printing couple with a spur gear mounted on each plunger of each unit to impart rotary motion to the plunger and with adjacent spur gears of adjacent units being connected in a gear train to a common drive means. A rotatable cam shaft common to all pump units is connected to the common drive means and cam rises on the shaft engage a portion of each of the variable drive means to provide axial movement of the plunger in the pump casing.

3 Claims, 2 Drawing Figures

PRINTING INK METERING PUMP

BACKGROUND OF THE INVENTION

The invention relates generally to a variable stroke positive displacement liquid metering pump for use in a printing couple where it is desirous to accurately regulate the amount of ink being metered. Various type ink pumps have been proposed for use in printing couples, as for example pumps as disclosed in U.S. Pat. Nos. 1,311,198 and 1,348,198 which utilize plungers which are moveable in reciprocal directions in bores in combination with moveable slides having liquid passageways therein. Further examples of metering pump constructions which utilize plungers moveable in bores are shown in U.S. Pat. Nos. 1,185,667 and 1,214,856 but which require use of separate valves in the form of ball checks. Such pumps have been subjected to problems in that they are not easily adjusted in order to vary the amount of ink being pumped or that they have utilized moveable parts such as ball checks and slides which, because of the nature of the liquid being pumped, often are subjected to undue wear resulting in inaccurate metering. This is in part because printing ink is not a true liquid but rather a suspension of finely dispersed solids in an oily carrier fluid where the solids act as an abrasive. A further difficulty arising from using pumps having valves is the difficulty of accurately metering flow due to inherent non-lineal flow characteristics of valves. Also use of valves increases problems of leaking and "bleeding" which becomes of particular concern when the amount of liquid to be metered is small or approaches zero.

Valveless pump constructions have been proposed which utilize plungers moveable in pump casings where the plungers have a cut-out portion and means are included to rotate the plunger in timed relationship to its longitudinal movement, such that the cut-out portions overlie outlet and inlet ports. For example, see the constructions of U.S. Pat. No. 3,636,873 and U.S. Pat. No. 3,914,073. Such constructions however have required use of complicated and expensive means to vary the stroke of the plungers in order to vary metering. It is therefore an object of my invention to provide for a pumping unit which has the advantages of a valveless construction and which is adapted for accurately metering an abrasive fluid such as ink while at the same time providing easily manufactured and dependable structure for varying the metering by varying the intake stroke of a pump plunger.

GENERAL SUMMARY OF THE INVENTION

Broadly a liquid metering pump unit constructed according to my invention comprises a cylindrical pump casing having an inlet and outlet port through which a rotatable plunger is adapted to slide in an axial direction. The plunger has a flat portion at one end which is adapted to overlie the inlet and outlet ports during different degrees of rotation and different axial positions of the stroke and the plunger has a spur gear mounted thereon whereby the plunger may be rotated. A variable drive means in the form of a slidable U-shaped yoke is provided wherein one leg of the yoke rotatably supports one end of the plunger and the other leg of the yoke rotatably supports an adjustment screw. The end of the adjustment screw is adapted to engage the rise of a cam shaft and is urged in contact with the rise by means of a spring. Adjustment of the threaded screw moves the yoke relative to the cam shaft to vary the intake stroke of the plunger.

A plurality of pump units are arranged across a printing couple with adjacent spur gears of adjacent units meshing to form a gear train which in turn is connected to a common power drive. The cam shaft has a cam rise thereon for each unit and is also connected to the common drive. The spur gear and each rise of the cam shaft rotates in the ratio of 1 to 1 to each other so that upon each 360° rotation of the plunger, there will be a complete intake and outlet stroke of the plunger to assure proper sealing of the inlet and outlet ports.

DESCRIPTION OF THE PREFERRED EMBODIMENT

Figure 1:
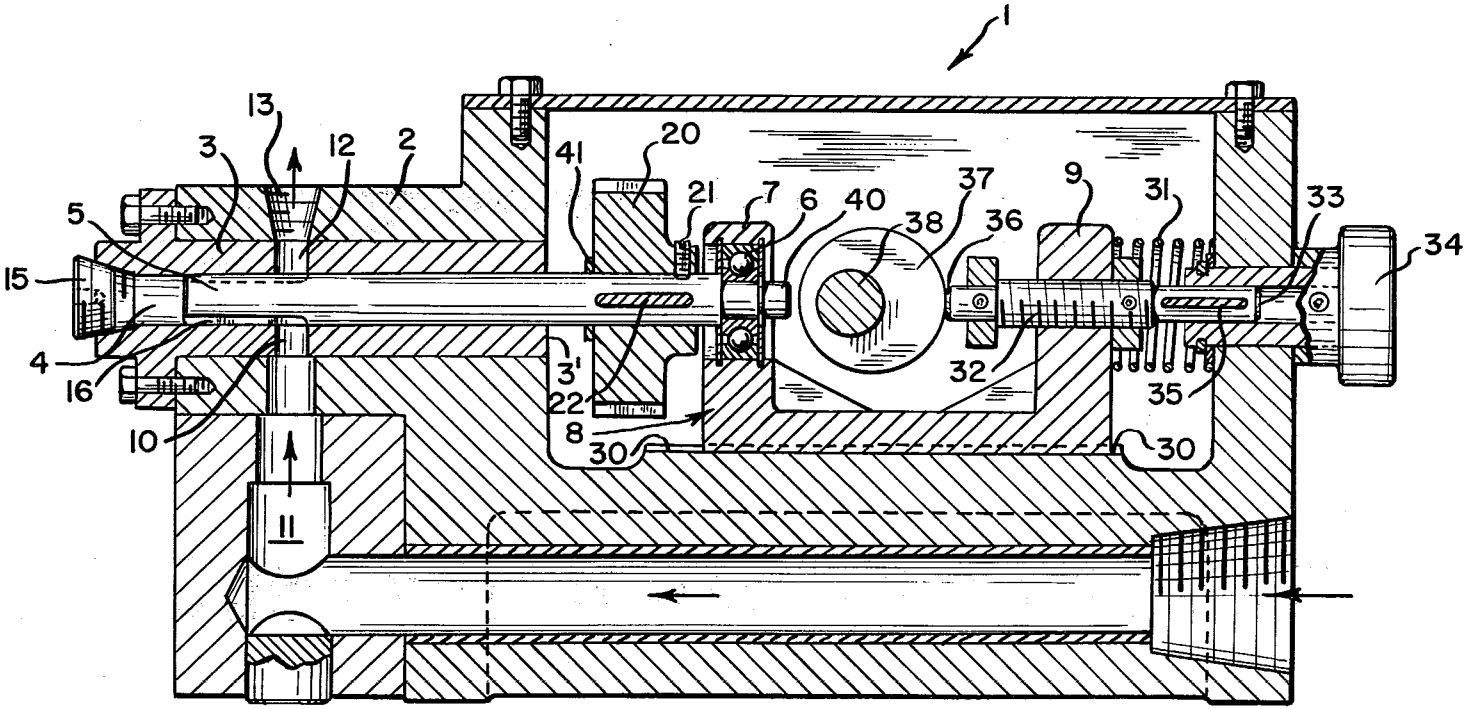
FIG. 1 is a side sectional view of a pump unit constructed according to the invention.

Referring to FIG. 1 there is illustrated an individual metering pump unit 1 of a printing pump assembly constructed according to the invention where the unit has a housing 2 containing a pump cylinder or casing 3 defining in part a pump chamber 4. A rotatable and axially reciprocal moveable cylindrical plunger 5 extends through one axial end 3' of the cylinder 3 and is rotatably supported at one end by means of a ball bearing assembly 6 carried on a vertical leg 7 on a slidable U-shaped yoke 8.

The cylinder 3 has an inlet port 10 which connects with an inlet duct 11 which in turn connects to an ink supply, not shown. An outlet port 12 is included in the cylinder 3 diametrically opposite the inlet port and connects with an outlet duct 13 which in turn extends to an ink motion of a printing couple, both not shown. Plug 15 seals one end of the chamber 3 to form one end of the pump chamber 4.

The cylindrical plunger has a cutout or flat portion 16 which is adapted to extend over both the inlet and outlet ports during different degrees of rotation to form entry and exit passageways to the pump chamber. The cylindrical sides of the plunger are adapted to extend over and seal the inlet and outlet ports when they are not overlaid by the flat portion 16.

Figure 2:
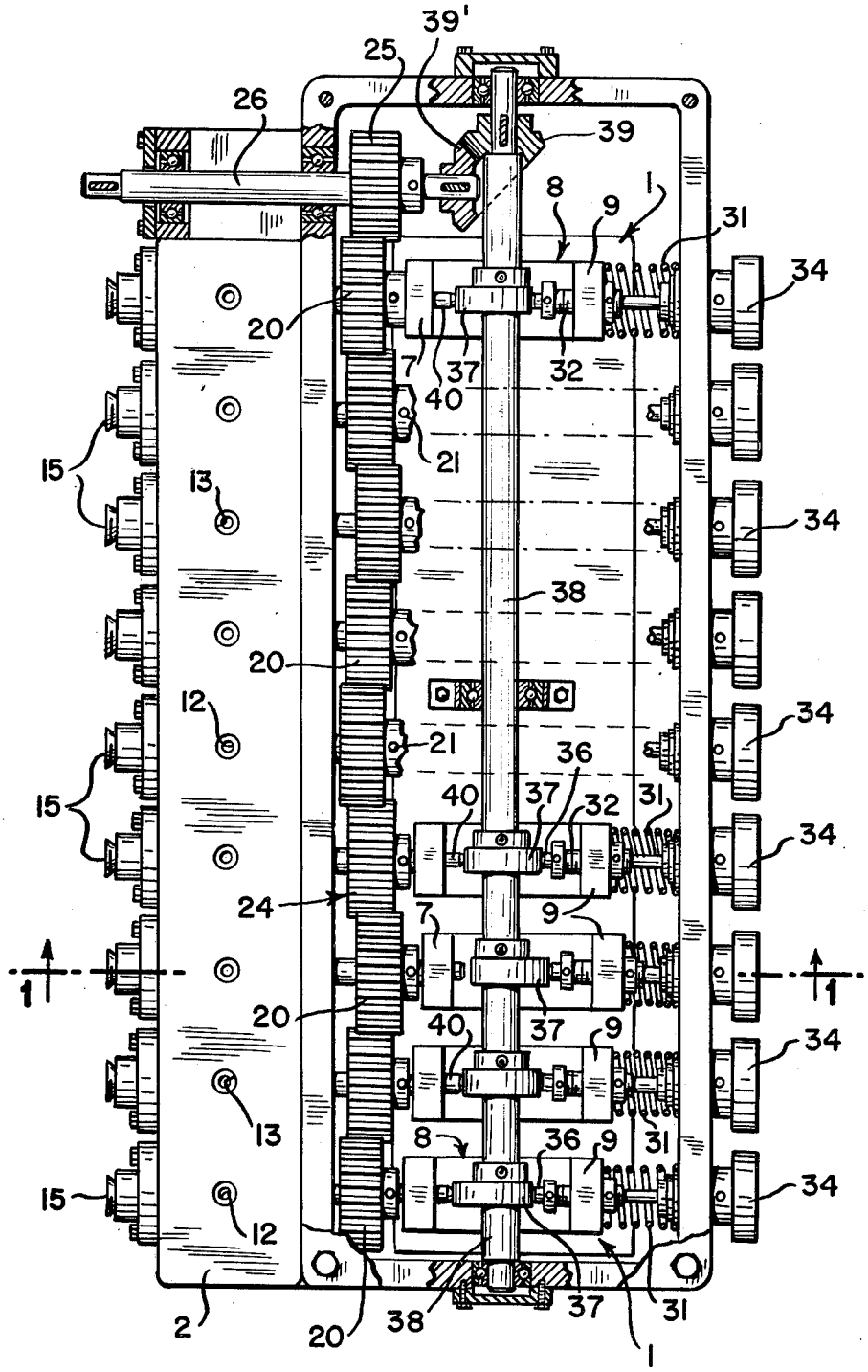
FIG. 2 is a partial plan view of a plurality of pump units of the type shown in FIG. 1 extending across a printing couple.

The plunger has a spur gear 20 connected thereto by a set screw 21 and a key 22 in order that the plunger may be rotated. As shown in FIG. 2, the various pump units 1 of the pump assembly are positioned in a line across the width of a printing couple such that the gears 20 of each unit mesh with the gears of adjacent units to form a gear train 24 which is operatively connected to a main spur gear 25 mounted on a central drive shaft 26. In this manner the main drive shaft 26 provides the driving force by which all of the individual plungers of each of the printing units are rotated in unison.

The U-shaped yoke 8 is slidable along a flat surface 30 of the housing 2 with the yoke being urged in the left-hand or pumping stroke direction as shown in the drawings by means of a compression spring 31 which is positioned between the housing 2 and the vertical leg 9 of the yoke 8.

An adjustment screw 32 is threaded into the leg 9 and has an end 33 which slides within an adjustment knob 34. Knob 34 is keyed to the end 33 by way of a key 35 such that rotation of the adjustment knob 34 will rotate the threaded screw 32 within the leg 9 moving it axially with respect to the leg.

The spring 31 urges the yoke in the left or pumping direction as shown in the drawings such that the end 36 of the screw contacts a cam rise 37 contained on a rotatable cam shaft 38. Cam shaft 38 as shown in FIG. 2 extends across the width of the printing couple and has a plurality of cam rises 37 thereon, each of which contacts an adjustment screw of an associated printing unit. The end of the cam shaft 38 is connected by means of bevel gears 39 and 39' to the central drive shaft 26. It is thus seen that for each rotation of the shaft 26, there will be a corresponding rotation of each spur gear 24 and plunger 5 as well as a corresponding rotation of each cam rise 37.

As shown in FIG. 1, movement of the yoke 8 in the right-hand direction to withdraw the plunger from the pump cylinder on an intake stroke is accomplished by the cam rise 37 engaging the end 36 of the adjustment screw 32. Movement of the yoke and plunger in the left direction on a pumping stroke is accomplished by the force of the spring 31 which moves the yoke to the left until the shoulder 41 on the spur gear 20 engages the axial end 3' of the cylinder 3. Varying the positioning of the adjustment screw 32 by the adjustment knob 34 will in turn vary the intake stroke of the plunger 5 to regulate the amount of ink pumped. Thus adjustment of the screw to move it to the right with respect to the yoke 8 will increase the distance between its end 36 and the end 40 of the plunger resulting in a decrease of the intake stroke and amount of ink pumped. Adjustment of the screw to rotate it so as to move it to the left with respect to the yoke 8 will decrease the distance between the end 36 and the end 40 of the plunger and thus increase the intake stroke to increase the amount of ink pumped.

The cam shaft 38 is so positioned with respect to the end 40 of the plunger that there will be a spacing between the end 40 and the top of the cam rise 37 when the cam shaft is in the nine o'clock position and when the shoulder 41 engages the end 3' of the cylinder 3. In this position of the plunger where the shoulder 41 engages the end of the cylinder, the flat portion 16 will extend beyond the inlet and outlet ports 10 and 12 with both ports being sealed off by the cylindrical portion of the plunger. This construction allows rotation of the plunger while maintaining both inlet and outlet ports sealed with the result that any ink "bleeding" to the ink rail is prevented when the plunger is at the limit of its pumping stroke. As the cam shaft 38 rotates to bring the rise 37 into contact with the end 36 of the adjustment screw, the plunger will be rotated at the same time such that the flat portion 16 will be in a position to overlie the port 10 when the plunger begins to move to the right on the intake stroke allowing ink to enter the pumping chamber.

In the event no ink is to be pumped by the unit, the knob and adjustment screw are rotated such that end 36 is continually out of contact with the cam rise 37 leaving the shoulder 41 engaging the end of the cylinder. Plunger 5 will continue to be rotated by gear 20 but since there will be no intake stroke, the ports will remain sealed by the cylindrical portion of the plunger with the result that no ink will be pumped.

The construction illustrated thus provides a simplified structure for assuring positive pumping action which may be easily regulated and which at the same time will prevent any ink "bleeding".

I claim:

1. A variable stroke positive displacement liquid pump unit for metering a precise amount of printing ink for use with a printing press, said pump unit comprising a cylindrical pump casing, an inlet port and an outlet port in the sides of said casing, a rotatably and reciprocally moveable cylindrical plunger extending into said casing through one axial end thereof with said plunger having an axially extending flat portion adapted to overlie said inlet port and said outlet port during different degrees of rotation of said plunger and during different amounts of stroke of the plunger and having the cylindrical plunger extend over said inlet and outlet port when said plunger is completely extended into said casing, means for rotating said plunger whereby the flat portion extends over said inlet port during a portion of the axial movement of said plunger out of said casing and over said outlet port during a portion of the axial movement of said plunger into said casing, a slidable yoke rotatably supporting one end of said plunger, a rotatable cam shaft having a cam rise thereon, a rotatable screw threaded in said yoke on the opposite side of said cam shaft from said plunger and adapted to engage said cam rise when said plunger is moved out of said pumping chamber, spring means urging said screw toward said cam rise and said plunger into said casing, and adjustment means for rotating said screw to vary its position with respect to said one end of said plunger whereby the amount of movement of said yoke and plunger in a direction away from said pumping chamber may be varied.

2. An ink pump for providing ink in metered quantities to an ink rail of a printing device of a printing couple; said pump having a plurality of pump units wherein each pump unit has a cylindrical pump casing; an inlet port and an outlet port in the sides of said casing; a rotatable cylindrical plunger movable axially into and out of said casing adapted to overlie said inlet port and said outlet port when said plunger is moved completely into said casing; a flat portion disposed on one end of said plunger adapted to overlie said inlet port and said outlet port during different degrees of rotation of said plunger when said plunger is moved outwardly of said casing; spur gear means for rotating said plunger; a single rotatable cam shaft connected to a common drive shaft; and variable drive means for imparting varying axial movement to said plunger out of said pump casing whereby the amount of fluid drawn into said pump casing through said inlet port may be varied, said variable drive means including a slidable yoke rotatably supporting one end of said plunger, a rotatable screw threaded into said yoke on the opposite side of said cam shaft from said plunger and adapted to engage a cam rise on said cam shaft when said plunger is moved out of said pump casing, spring means urging said screw toward said cam rise and adjusting means for rotating said screw to vary its position with respect to said one end of said plunger whereby the amount of movement of said yoke and plunger in the direction away from said pump casing may be varied.

3. An ink pump according to claim 2 wherein said common drive shaft and each said spur gear rotate with the ratio of 1 to 1 with respect to each other.

* * * * *